US010708991B2

(12) United States Patent
Carreras Molins et al.

(10) Patent No.: US 10,708,991 B2
(45) Date of Patent: Jul. 7, 2020

(54) CONTROLLING LIGHTING DEVICES

(71) Applicant: LEDMOTIVE TECHNOLOGIES, S.L., Barcelona (ES)

(72) Inventors: Josep Maria Carreras Molins, Barcelona (ES); Aleix Llenas Farràs, Barcelona (ES)

(73) Assignee: LEDMOTIVE TECHNOLOGIES, S.L., Barcelona (ES)

( * ) Notice: Subject to any disclaimer, the term of this patent is extended or adjusted under 35 U.S.C. 154(b) by 0 days.

(21) Appl. No.: 16/480,860

(22) PCT Filed: Jan. 25, 2017

(86) PCT No.: PCT/ES2017/070041
§ 371 (c)(1),
(2) Date: Jul. 25, 2019

(87) PCT Pub. No.: WO2018/138388
PCT Pub. Date: Aug. 2, 2018

(65) Prior Publication Data

US 2019/0364638 A1 Nov. 28, 2019

(51) Int. Cl.
*G09G 5/02* (2006.01)
*H05B 45/20* (2020.01)
*H05B 45/00* (2020.01)

(52) U.S. Cl.
CPC ..... *H05B 45/20* (2020.01); *H05B 45/60* (2020.01)

(58) Field of Classification Search
None
See application file for complete search history.

(56) References Cited

U.S. PATENT DOCUMENTS 6,741,351 B2 5/2004 Marshall et al.
2005/0040774 A1 2/2005 Mueller et al.
(Continued)

OTHER PUBLICATIONS

International Search Report and Written Opinion of the International Searching Authority. International Application No. PCT/ES2017/070041 issued by the European Patent Office, dated May 19, 2017, 18 pages, Rijswijk, NL.

*Primary Examiner* — Minh D A
(74) *Attorney, Agent, or Firm* — Peter B. Scull; HDC IP Law LLP

(57) ABSTRACT

Methods are provided for controlling a lighting device with light-channels to produce illumination based on a reference spectral power distribution (SPD); including: determining first adjustments of the light-channels for minimizing first spectral deviation between a first calculated SPD and the reference SPD, the first calculated SPD depending on predefined SPDs of the light-channels and the first adjustments; inducing the light-channels to emit lights based on the first adjustments; receiving sensor signals from a colour sensor representing colour coordinates of a mixture of lights produced by the light mixer as a result of mixing the lights emitted by the light-channels; performing an optimization process producing second adjustments for minimizing a colour deviation between colour coordinates of reference and the colour coordinates of the mixture of lights; and inducing the light-channels to emit lights based on second adjustments. Controllers and computer programs suitable for performing such methods are also provided.

20 Claims, 5 Drawing Sheets

(56) References Cited

U.S. PATENT DOCUMENTS

| | | | | |
|---|---|---|---|---|
| 2006/0018118 | A1 | 1/2006 | Lee et al. | |
| 2007/0115665 | A1 | 5/2007 | Mueller et al. | |
| 2008/0180670 | A1 | 7/2008 | Carsten | |
| 2008/0246419 | A1 | 10/2008 | Deurenberg | |
| 2010/0188022 | A1 | 7/2010 | Gerlach et al. | |
| 2012/0235600 | A1 | 9/2012 | Simonian et al. | |
| 2013/0307419 | A1 | 11/2013 | Simonian et al. | |
| 2014/0055038 | A1 | 2/2014 | Cappitelli et al. | |
| 2015/0035440 | A1* | 2/2015 | Spero | B60Q 1/1423 315/153 |
| 2015/0123564 | A1 | 5/2015 | Simonian et al. | |
| 2015/0335246 | A1* | 11/2015 | Rains, Jr. | F21V 23/003 362/231 |
| 2016/0192454 | A1 | 6/2016 | Simonian et al. | |

* cited by examiner

CONTROLLING LIGHTING DEVICES

The present disclosure relates to methods for controlling lighting devices to produce illumination based on a reference spectral power distribution, and to computer programs and controllers (systems) suitable for performing such methods.

BACKGROUND

Light sources to generate white or coloured light are well known. Typically, a light source is defined by its light output in lumens or Watts, and other features such as those parameters that may be derived from the light spectrum such as e.g. the colour coordinates in a given colour space, the correlated colour temperature (CCT), the colour rendering index (CRI), the gamut area index (GAI), etc.

In recent days more indicators are appearing that account for the interaction between the spectral power distribution (or spectrum) of a light source and different biological systems, such as the human brain, plants or other animals. All these applications, each of them with their own indicators, highlight the importance that a control over the spectral power distribution of the light has in professional environments where the properties of light have to be carefully controlled.

In order to be able to shape the spectral power distribution, the light source that produces the light output may require being composed of individually addressable wavelength light channels and a control unit for calculating the weights (or adjustments) to be provided to every light channel to obtain the target spectrum.

A light channel may be defined herein as a light production unit which is independently (individually) addressable (controllable) by the controller. A light channel may be constituted by one or more light emitters according to the light emission characteristics of said light emitters; i.e. light emitters with substantially homogeneous light emission properties may form a particular light channel. A lighting device may have an arbitrary number of light emitters and corresponding light channels.

Several control methods can be found in the background art that aim at having a well-defined spectral power distribution.

In an example, a target spectrum is matched using a luminaire having a plurality of known LEDs (their spectrum characteristics are known), by theoretically estimating the contribution (coefficient or weight) of each LED. The method further describes calculating the CIE chromaticity coordinates of the target spectrum and calculating the CIE coordinates of the LED luminaire light spectrum and fine-adjusting the contribution of each LED to minimize the chromaticity error. This seems to describe an optimization based on calculations that take into account pre-known features of the LEDs. A drawback of this approach is that either temperature changes or the aging of the LEDs may cause a loss of knowledge of the pre-known features of the LEDs, so that the reproduction of the target spectrum may be less accurate over time.

In another example, described is another LED luminaire having a plurality of LEDs capable of reproducing a target spectrum. The optimization of the emitted spectrum vs. target spectrum is performed using spectrometer data, which necessarily comes from a spectrometer. This device may thus result expensive due to the cost of spectrometers.

In a further example, described is a luminaire capable of reproducing a desired target spectral power distribution using a plurality of LEDs. An optical measurement device is used to measure emitted light, the optical measurement device being able to measure the emitted spectrum and is a spectrometer or a plurality of colour optical sensor matching the light emitters of the luminaire. This device may thus also be relatively expensive.

An object of the present disclosure is improving the prior methods, computer programs and controllers (systems) for controlling lighting devices to produce illumination based on a reference spectral power distribution.

SUMMARY

In a first aspect, a method is provided for controlling a lighting device by a controller, for the lighting device to produce illumination based on a reference spectral power distribution (SPD), the lighting device including a plurality of light channels with predefined spectral power distributions, a light mixer, and a colour sensor.

The method includes determining, by the controller, first intensity adjustments of the light channels for minimizing a first spectral deviation between a first calculated spectral power distribution (SPD) and the reference spectral power distribution (SPD), wherein the first calculated spectral power distribution depends on the predefined spectral power distributions of the light channels and the first intensity adjustments.

The method may further include sending, by the controller, first control signals to the light channels for inducing the light channels to emit lights based on the first intensity adjustments.

The method may still further include receiving, by the controller, sensor signals from the colour sensor representing colour coordinates of a mixture of lights produced by the light mixer as a result of mixing the lights emitted by the light channels.

The method may yet further include performing, by the controller, an optimization process producing second intensity adjustments for minimizing a colour deviation between colour coordinates of reference and the colour coordinates of the mixture of lights.

The method may additionally include sending, by the controller, second control signals to the light channels for inducing the light channels to emit lights based on the second intensity adjustments.

The proposed method permits reproducing a target or reference spectrum without the need of using a spectrometer or other expensive devices for measuring light. A colour sensor is used as feedback instead of a spectrometer, which may make the lighting device significantly cheaper in comparison with the use of a spectrometer or other expensive light measuring devices.

The method is based on minimizing a spectral deviation between the target spectrum and a theoretical spectrum depending on predefined spectra of the light channels and first intensity adjustments of the light channels. Once the spectral deviation has been minimized, any deviation between the colour of the mixed or mixture of lights from the emitters (measured by the colour sensor) and a colour of reference may be minimized by producing second intensity adjustments of the light channels.

In other words, light channels may firstly be adjusted for minimizing a spectral deviation with respect to the target spectrum, and may secondly be adjusted for minimizing colour deviation(s) with respect to the target colour (or colour of reference) due to the first adjustment(s). As commented in other parts of the disclosure, the second adjustments may be determined as a closed-loop.

It has been experimentally proven that application of the first and second intensity adjustments to the light channels causes reproduction of the target spectrum with acceptable (spectral and colour) accuracy in a (much) cheaper manner, since only a colour sensor is used as feedback instead of a spectrometer or other expensive light measuring devices.

Relevant drawbacks and complexities have been overcome in the conception of the suggested solution based on using a (single) colour sensor, because an infinite number of spectra can result in the same colour coordinates. Thus, only with a measuring colour sensor, it is not physically possible to find out which spectrum is originating a particular colour point measured by the colour sensor.

Prior lighting devices seem to use a spectrometer or a plurality of colour optical sensors that spectrally match the light channels (LED channels), because colour information has less information than spectral information. In fact, an infinite number of light spectra can give rise up to the same colour coordinates, so colour measurement is not considered a valid property to (easily) discern between light spectra.

In some implementations, the colour coordinates of reference (or target colour coordinates) may be substantially equal to colour coordinates defined by the reference spectral power distribution (SPD). This may permit producing illuminations with "consistent" light spectrum and colour, since the target colour coordinates are those defined by the reference spectrum. No perceptible transition effects from one light spectrum to another light spectrum (defining a different colour) are therefore induced in this case. Target colour coordinates slightly different to those defined by the target spectrum may be used to reproduce the target spectrum with acceptable accuracy, i.e. as perceived by people "consuming" the illumination produced by the lighting device.

In alternative examples, the colour coordinates of reference may be different from the colour coordinates of the reference spectral power distribution. This may permit e.g. transitioning from the reference (or target) light spectrum to another light spectrum that defines the target colour coordinates, in a manner that the (initial) reference spectrum is minimally altered. That is, smooth illumination transitions may be caused by considering a target colour which is different from the one defined by the target spectrum. These smooth transitions may permit producing interesting light effects in lots of applications.

In some examples, receiving the sensor signals from the colour sensor, performing the optimization process, and sending the second control signals to the light channels may be performed as a closed-loop. Therefore, the optimization process may iteratively progress towards an optimal solution including optimal (second) adjustments of the light channels that minimize the colour deviation.

That is, once the light channels are emitting lights based on the first adjustments which minimize the first spectral deviation (to the reference spectrum), such a closed-loop may be performed on colour coordinates. The closed-loop may iteratively approximate the colour point of the mixed light (sensed by the colorimeter) to the colour point of the target light (defined by the target spectrum), while keeping in turn the first spectral deviation within a certain tolerance.

According to examples, performing the optimization process may include minimizing, by the controller, the colour deviation under a constraint inducing the colour deviation to be less than a colour deviation threshold. The colour deviation threshold may be expressed in colour differences in the CIE 1976 [L*, u*, v*] colour space ($\Delta E^*_{uv}$), and may be (pre)defined depending on e.g. the colour coordinate under consideration and the accuracy needed for the particular application. In some examples, the colour deviation threshold may be of between $\Delta E^*_{uv}=10^{-5}$ and $\Delta E^*_{uv}=10^{-1}$, and preferably equal to approximately $\Delta E^*_{uv}=10^{-3}$. In alternative implementations, the colour deviation threshold may be equal to a smallest colour deviation recorded previously (i.e. a minimum in a function defined by all the colour deviations occurred in previous iterations of the closed-loop). A smallest colour deviation substantially equal to zero may indicate that an optimal solution has been reached, in which case the closed-loop may be ended.

In examples of the method, performing the optimization process may include minimizing, by the controller, the colour deviation under a constraint inducing a second spectral deviation to be less than a spectral deviation threshold. The second spectral deviation may be a deviation between a second calculated spectral power distribution and the reference spectral power distribution, the second calculated spectral power distribution depending on the predefined spectral power distributions of the light channels and the second intensity adjustments. The second (and/or the first) spectral deviation(s) may be a relative error (e.g. Root Mean Squared relative Error) that may be expressed as a percentage. The spectral deviation threshold may be of between 0.01% and 25%, and preferably equal to approximately 5% or, alternatively, may be equal to a smallest second spectral deviation recorded previously (i.e. a minimum in a function defined by all the second spectral deviations occurred in previous iterations of the closed-loop). A smallest second spectral deviation substantially equal to zero (0%) may indicate that an optimal solution has been reached, in which case the closed-loop may be ended depending on whether e.g. an admissible balance between imposed constraints has been achieved. In some implementations, the second (and/or the first) spectral deviation(s) may be an absolute error which may be expressed in pertinent absolute units. This absolute error could be used according to same principles or similar (equivalent) to those considered in the case of using a relative error.

In examples wherein first and second constraints are considered, the method may thus progress towards an optimal solution including optimal (second) adjustments minimizing both the colour deviation (according to first constraint) and the second spectral deviation (according to second constraint). In some implementations, the first constraint may take precedence over the second constraint.

In some examples, any data required for determining the first intensity adjustments (before the closed-loop) and the second intensity adjustments (within the closed-loop) may be retrieved, by the controller, from a memory disposed in the lighting device. In alternative implementations, any of said required data may be received, by the controller, from a remote location through a communication module. Details about these considerations have been provided in other parts of the present disclosure.

In some implementations, performing the optimization process may include performing, by the controller, a proportional-integral-derivative (PID) control method, and/or a Kalman filter method, and/or a fuzzy logic method, and/or a state variable method, etc. In general, any known statistical or machine learning method that may optimize or minimize a given variable depending on other variables may be used.

According to examples, performing the optimization process may include varying, by the controller, at least part of the second intensity adjustments according to one or more variation criteria. Said variation may be random and, in particular examples, a Monte Carlo or annealing method may be used for implementing said random variation.

In implementations of the method, varying the at least part of the second intensity adjustments may include determining, by the controller, a selection of the light channels and varying, by the controller, the second intensity adjustments corresponding to the selection of the light channels. As described in detail in other parts of the present disclosure, different approaches may be used to determine which of the emitters can be selected to be varied.

In a second aspect, the present subject matter also refers to a computer program product having program instructions for causing a controller to perform a method as defined above of controlling a lighting device for producing illumination based on a reference spectral power distribution.

In a third aspect, a controller is provided for controlling a lighting device for producing illumination based on a reference spectral power distribution, the lighting device having a plurality of light channels with predefined spectral power distributions, a light mixer, and a colour sensor; and the controller being configured to perform any of the methods described before for controlling the lighting device. The controller may be implemented by a computer, electronic components or a combination thereof, as described in more detail in other parts of the disclosure. The lighting device may further include the controller.

In some implementations, the lighting device may include a light mixer such as the ones described in detail in other parts of the disclosure.

The term "mixed light" may be defined as the lights emitted by the light channels once said lights have interacted with the light mixer, so that the mixed light results homogeneous within acceptable tolerances. Therefore, the light that arrives to the colour sensor, as well as the light in the far field, is considered mixed light because it has contributions from all the light channels that have been mixed in some way (by the light mixer).

These and other advantages and features will become apparent in view of the detailed description and drawings.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
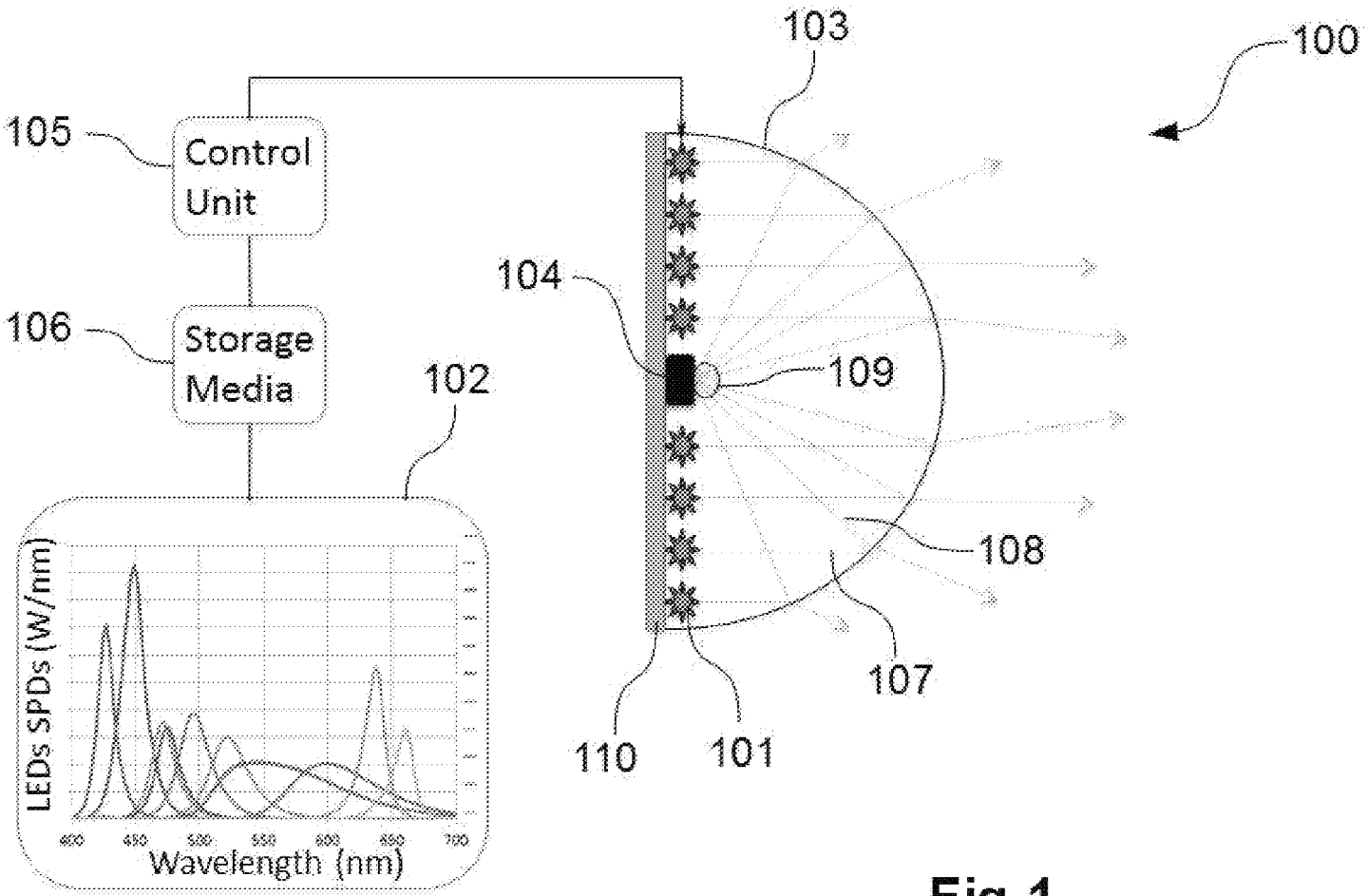
FIG. 1 is a schematic representation of a lighting device according to examples.

FIG. 1 is a schematic representation of a lighting device 100 according to examples. The lighting device 100 may include a plurality of light channels 101 having predefined spectral power distributions 102, a light mixer 103, and a colour sensor (or colorimeter) 104. A controller 105 may be configured to perform methods of controlling the lighting device 100 for producing illumination based on a reference spectral power distribution (SPD). The controller 105 may be either internal or external to the lighting device 100. When the controller is disposed in the lighting device, the expression "controlling the lighting device" may be understood as equivalent to "controlling the light channels of the lighting device".

The plurality (or array) of light channels 101 may include e.g. LED channels, and/or OLED channels, and/or quantum dots, or any other electroluminescent source with a narrow-band spectral emission. The lighting device 100 may have a support base 110 (e.g. a flat panel or a Printed Circuit Board, PCB) supporting the light channels 101 at a main side of the base 110. The support base 110 may also support the colour sensor 104 at e.g. a substantially central position of the main side of the support base 110. In this way, the colour sensor 104 may sense similar contributions from all the light channels, favouring the mixing of light.

The light mixer 103 may have lenses or diffusers (placed in front of the light channels 101) for lensing or diffusing (and therefore mixing) the light rays 107 emitted by the light channels 101. The diffusers may have surface(s) for diffusely reflecting the light rays 107 emitted by the light channels 101, and/or translucent object(s) for letting the lights 107 (emitted by the light channels 101) to pass through them towards the outside, with a homogeneous colour mixing within acceptable tolerance(s). The diffusers may include objects with light reflectivity or light transmissivity or both functions. The light mixer 103 may be generally made of materials such as e.g. plastic and/or glass and/or similar materials (e.g. glassy materials).

The light mixer/diffuser may have a mixing chamber covering the light channels 101, so that the light rays 107 emitted by the light channels 101 may be reflected partially and internally to the mixing chamber. Reflected light rays 108 may thus result mixed in the sense that photons from substantially all the light channels 101 are mixed and a substantially uniform pattern is formed (at the location of the colour sensor 104).

The colour sensor 104 may have diffusing material in front (in the vicinity) of corresponding light inlet(s) to improve the mixing of the lights (from light emitters 101) at the location of the colour sensor 104, so that the resulting mixed light (or mixture of light) may be even more representative of the colour mixing at the far field.

Mixed light (or mixture of light) 109 may be received and therefore sensed by the colour sensor or colorimeter 104. The mixing chamber may be made of e.g. plastic and/or glass and/or similar materials (e.g. glassy materials). As shown in the figure, the mixing chamber may be also supported by the support base 110 completely or partially covering the light channels 101.

The light mixer may include a shell mixer including mini-lenses arranged on outer and inner surfaces of a (thin) hollow dome covering the light channels 101. Mini-lenses may include Köhler integration so that a homogeneous output light may be generated by the shell mixer with a more compact structure.

Mixing chamber and shell mixer may be structurally similar to each other. However, mixing chamber may be mostly based on diffusing elements and/or reflecting elements, whereas shell mixer may be predominantly based on micro-lenses.

The lighting device 100 may have a storage media (memory) 106 for storing any data to be retrieved and processed by the controller 105 for controlling the (light channels 101 of the) lighting device 100. For example, the reference spectral power distribution (SPD), the predefined spectral power distributions 102 of the light channels 101, etcetera may be stored in said memory 106.

The lighting device 100 may further include a communication module (not shown) so that the controller 105 may exchange data with remote locations/systems through wired and/or wireless connection(s). The communication module may include a receiver for receiving data and a transmitter for transmitting data.

The controller 105 may receive any data through the communication module to be processed for controlling the (light channels 101 of the) lighting device 100. For example, the reference spectral power distribution, the predefined spectral power distributions 102 of the light channels 101, etcetera may be received by the controller 105 through the communication module.

The controller 105 and the light channels 101 may be connected through any kind of connection(s) so that control signals from the controller 105 may be received by the light channels 101 through said connection(s).

In particular, a driver or driving stage (not shown) may be used between the controller 105 and the light channels 101 to provide the proper electrical power levels to the light channels. The controller 105 may thus induce the adjustments (or weights) of the light channels 101 by providing suitable control signals to the driving stage (Pulse Width modulation or PWM signals, Pulse Density Modulation or PDM signals, constant current, constant voltage, or by any other well-known method for driving light emitters, such as e.g. LEDs).

The controller 105 and the colour sensor 104 may be connected through any type of connection(s) so that sensor signals from the colour sensor 104 may be received by the controller 105 through said connection(s).

The controller 105 may be implemented by a computer, electronic devices or a combination thereof. The computer may be or include a set of instructions (that is, a computer program) and then the controller 105 may include a memory and a processor, embodying said set of instructions stored in the memory and executable by the processor. The memory may be e.g. the storage media 106. The instructions may include functionality to execute methods of controlling the (light channels 101 of the) lighting device 100 for producing illumination based on reference spectral power distribution (SPD).

In case the controller 105 is implemented only by electronic componentry, the controller may be, for example, a microcontroller, a CPLD (Complex Programmable Logic Device), an FPGA (Field Programmable Gate Array) or an ASIC (Application-Specific Integrated Circuit).

In case the controller 105 is a combination of electronic and computing devices or systems, the computer may include a set of instructions (e.g. a computer program) and the electronic componentry may be any electronic circuit capable of implementing the corresponding step or steps of the cited methods of controlling the (light channels 101 of the) lighting device 100.

The computer program may be embodied on a storage medium (for example, a CD-ROM, a DVD, a USB drive, a computer memory or a read-only memory) or carried on a carrier signal (for example, on an electrical or optical carrier signal).

The computer program may be in the form of source code, object code, a code intermediate source and object code such as in partially compiled form, or in any other form suitable for use in the implementation of methods of controlling the lighting device. The carrier may be any entity or device capable of carrying the computer program.

For example, the carrier may include a storage medium, such as a ROM, for example a CD ROM or a semiconductor ROM, or a magnetic recording medium, for example a hard disk. Further, the carrier may be a transmissible carrier such as an electrical or optical signal, which may be conveyed via electrical or optical cable or by radio or otherwise.

When the computer program is embodied in a signal that may be conveyed directly by a cable or other device or otherwise, the carrier may be constituted by such cable or other device or otherwise.

Alternatively, the carrier may be an integrated circuit in which the computer program is embedded, the integrated circuit being adapted for performing, or for use in the performance of, the relevant methods.

Figure 2:
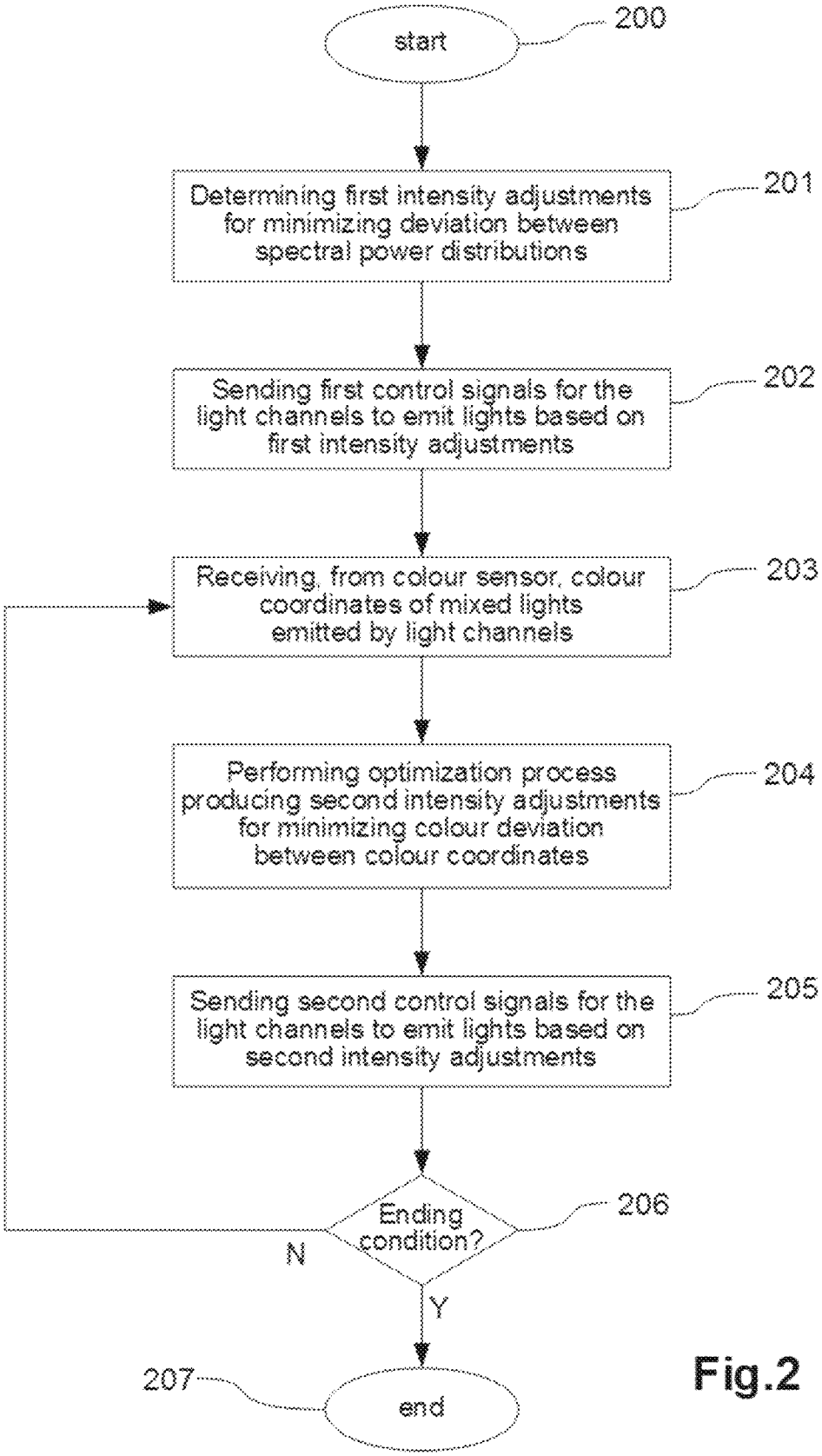
FIG. 2 is a flowchart schematically illustrating methods according to examples for controlling a lighting device such as the one shown by FIG. 1.

FIG. 2 is a flowchart schematically illustrating examples of a method of controlling a lighting device such as the one shown by FIG. 1. Number references from FIG. 1 may thus be reused in following description of FIG. 2.

At block 200, the method may be started as a result of e.g. receiving by the controller 105 a request of producing illumination based on a given reference spectral power distribution (SPD). Said request may include an identifier uniquely identifying the reference spectral power distribution to be reproduced, for example.

At block 201, the controller 105 may determine first intensity adjustments (or weights) of the light channels 101 for minimizing a first spectral deviation between a first calculated spectral power distribution and the reference (or target) spectral power distribution, the first calculated spectral power distribution (SPD) depending on the predefined spectral power distributions 102 of the light channels 101 and the first intensity adjustments (or weights) of the light channels 101. Any known optimization (or fitting) method may be used in this block adapted for the mentioned purpose.

At block 202, the controller 105 may send first control signals to the light channels 101 for inducing the light channels 101 to emit lights 107 based on the first intensity adjustments (obtained at previous block 201).

At block 203, the controller 105 may receive sensor signals from the colour sensor 104 representing colour coordinates of the lights emitted by the light channels 101 once mixed by the light mixer 103 (i.e. mixed light 109).

At block 204, the controller 105 may determine second intensity adjustments of the light channels 101 for minimizing a colour deviation between the colour coordinates of the mixed lights (or mixture of lights) 109 and the colour coordinates of reference. To this end, the colour coordinates of the mixed lights 109 may be used to perform corresponding optimization (minimization) process producing the second intensity adjustments for minimizing the colour deviation. As in the case of block 201, any known optimization method may be used to implement this block 204. The colour coordinates of reference may be equal or different to colour coordinates defined by the reference spectral power distribution.

At block 205, the controller 105 may send second control signals to the light channels 101 for inducing the light channels 101 to emit lights 107 based on the second intensity adjustments.

At decision block 206, the controller 105 may verify whether an ending condition has occurred. In case of positive result of said verification, the method may include looping back to block 203 for carrying out a new iteration of blocks 203-206. Otherwise, the method may include transitioning to final block 207 for ending the execution of the method.

The ending condition may include a request of terminating the execution of the present method in order to e.g. reproduce illumination based on a new reference spectral power distribution. Said request may include an identifier uniquely identifying the new reference spectral power distribution (SPD) to be reproduced, for example.

As shown in FIG. 2, blocks 203-206 may be performed as a closed-loop method aimed at iteratively producing second intensity adjustments (and corresponding second control signals) in such a way that colour deviation between colour coordinates of the mixed lights (or mixture of lights) 109 and colour coordinates of reference is (progressively) minimized. In the first iteration of the closed-loop, lights emitted by light channels 101 and (once mixed by the light mixer 103) sensed by the colour sensor may be based on first intensity adjustments (from block 201) and, in subsequent iterations, lights emitted by light channels 101 and (once mixed by the light mixer 103) sensed by the colour sensor may be based on second intensity adjustments (determined at block 204 in previous iteration of the closed-loop).

The first intensity adjustments of the light channels 101 may have been pre-determined (in e.g. a previous execution of the method), so they may be (in present execution) retrieved from memory 106 or received through communication module of the lighting device 100. Alternatively, the first intensity adjustments may be determined in real time (in present execution) based on performing corresponding optimization method. In this case, the reference spectral power distribution and the predefined spectral power distributions 102 may be retrieved from the memory 106 or received through the communication module of the lighting device 100.

The predefined spectral power distributions 102 (of the light channels 101) may be e.g. datasets or theoretical functions resulting from factory measurements obtained during production or quality testing of the light channels 101.

The first calculated (or mixed) spectral power distribution may be generally expressed through e.g. the following formula.

$$\text{first_SPD}_{mixed}(\lambda) = \sum_{i=1}^{N} \text{first_weight}_i \times SPD^{i}_{channel}(\lambda) \qquad \text{Formula 1}$$

wherein first_SPD$_{mixed}(\lambda)$ is the first calculated (or mixed) spectral power distribution, N is the number of light channels, first_weight$_i$ is the first intensity adjustment (or weight) of the i-th light channel, and SPD$_{channel}^{i}(\lambda)$ is the predefined spectral power distribution of the i-th light channel.

Figure 3:
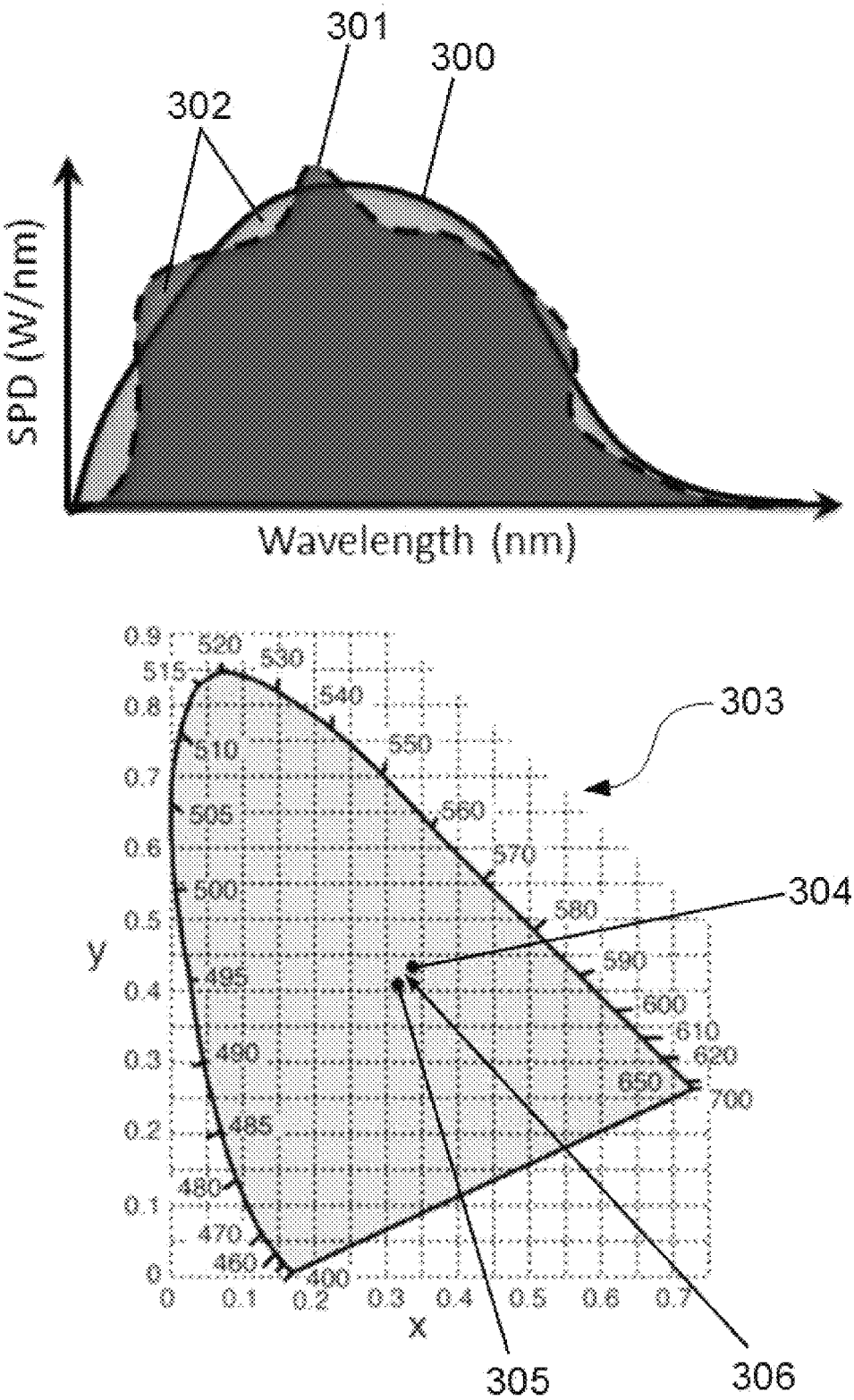
FIG. 3 is a schematic graphical representation of a deviation between the colour coordinates in the 1931 CIE xy diagram of spectral power distributions to be minimized in the context of methods such as the ones illustrated by FIG. 2.

FIG. 3 shows a graphical example of spectral deviation 302 between a calculated (or mixed) spectral power distribution 301 and the target (or reference) spectral power distribution (SPD) 300. The calculated spectral power distribution 301 may represent either the first calculated (or mixed) spectral power distribution used to determine the first intensity adjustments, or the second calculated (or mixed) spectral power distribution used to determine, in some examples, the second intensity adjustments.

FIG. 3 further shows a representation in the 1931 CIE xy colour space 303 of colour coordinates (or colour point) 305 of the mixed light (or mixture of lights) 109 and colour coordinates (or colour point) 304 of the reference spectral power distribution 300, and a deviation 306 between said colour points 304 and 305.

As commented before, known minimization (statistical) methods may be used to determine first intensity adjustments (or weights) of the light channels 101 in order to minimize e.g. an approximation error or deviation 302 between the target spectral power distribution 300 and the first calculated (or mixed) spectral power distribution (SPD) 301 as defined e.g. in previous Formula 1.

Since the predefined spectral power distributions 102 are theoretical or empirical functions or datasets (determined at manufacturing and/or testing time), a colour mismatch (or deviation) 306 may occur between colour point 304 of the reference spectral power distribution 300 and colour point 305 of the mixed light (or mixture of lights) 109 resulting from the first intensity adjustments (from block 201). This colour deviation 306 may be even aggravated due to statistical error(s) produced by the minimization (statistical) method used (at block 201) to determine the first intensity adjustments of the light channels 101. This colour deviation 306 may produce undesired colour effects that may be perceived by people "consuming" the light from the lighting device 100.

Minimization of the colour deviation 306 between colour point 304 (of the reference spectral power distribution 300) and colour point 305 (of the mixed light 109) may thus permit eliminating (or attenuating) undesired colour light effects, so that an acceptably accurate reproduction of the reference spectral power distribution 300 may be provided by the lighting device 100.

The colour coordinates 304 of the reference spectral power distribution 300 may be directly calculated by the controller 105 from the reference spectral power distribution 300, or, alternatively, retrieved (by the controller 105) from memory 106 of the lighting device 100 or, alternatively, received (by the controller 105) from a remote location through communication module of the lighting device 100.

The optimization method performed at block 204 may include, for example, performing a PID control method, and/or Kalman filter method and/or a fuzzy logic method and/or a state variable method, and/or any other known statistical or machine learning method or adapted to minimize the colour deviation 306.

It is known that constraints may be imposed in an optimization method such as the one performed at block 204. In this sense, a first constraint may be imposed to induce the colour deviation 306 to be less than a colour deviation threshold.

Implementations of the first constraint may include e.g. verifying whether the colour deviation 306 tends to be less than the colour deviation threshold through successive iterations of the closed-loop. In case of negative result of said verification, corrective actions may be undertaken to induce the first constraint to be finally satisfied.

The colour deviation threshold may be expressed in colour differences in the CIE 1976 [L*, u*, v*] colour space ($\Delta E^*_{uv}$), and may be (pre)defined depending on e.g. the colour coordinate under consideration and accuracy needed for the particular application. In particular, the colour deviation threshold may be of between $\Delta E^*_{uv}=10^{-5}$ and $\Delta E^*_{uv}=10^{-1}$, and preferably equal to approximately $\Delta E^*_{uv}=10^{-3}$. In alternative implementations, the colour deviation threshold may be equal to a smallest colour deviation registered previously (i.e. a minimum in a function defined by all the colour deviations 306 occurred in previous iterations of the closed-loop).

A second constraint may be further imposed to induce a second spectral deviation to be less than a spectral deviation threshold, the second spectral deviation being a deviation between a second calculated spectral power distribution and the reference spectral power distribution, the second calculated spectral power distribution depending on the predefined spectral power distributions 102 of the light channels 101 and the second intensity adjustments. Implementations of the second constraint may include e.g. verifying whether the second spectral deviation tends to be less than the spectral deviation threshold through successive iterations of the closed-loop. In case of negative result of said verification, corrective actions may be carried out to induce the second constraint to be finally satisfied.

The spectral deviation threshold may be e.g. of between 0.01% and 25%, and preferably equal to approximately 5%. Alternatively, the spectral deviation threshold may be equal to a smallest second spectral deviation registered previously (i.e. a minimum in a function defined by all the second spectral deviations occurred in previous iterations of the closed-loop).

The second calculated (or mixed) spectral power distribution may be generally expressed through e.g. the following formula.

$$\text{second_SPD}_{mixed}(\lambda) = \sum_{i=1}^{N} \text{second_weight}_i \times SPD^i_{channel}(\lambda) \qquad \text{Formula 2}$$

wherein $\text{second_SPD}_{mixed}(\lambda)$ is the second calculated (or mixed) spectral power distribution, N is the number of light channels, $\text{second_weight}_i$ is the second intensity adjustment (or weight) of the i-th light channel, and $\text{SPD}_{channel}^{i}(\lambda)$ is the predefined spectral power distribution (SPD) of the i-th light channel.

Relative priorities between the above first and second constraints may be defined, so that e.g. satisfaction of the first constraint may take precedence over the second constraint, or vice versa. These relative priorities may be defined in such a way that good balance between complete (or partial) satisfaction of both first and second constraints may be achieved.

In an example based on a PID control implementing the closed-loop, several input variables may be considered. For example, the PID control may have as inputs: the colour point 304 of the reference spectral power distribution 300, the colour point 305 of the mixed lights 109 and the second intensity adjustments or weights (from previous iteration). Further inputs may be e.g. the predefined spectral power distributions 102 of the light emitters 101, the predefined colour points of the light channels 101, predefined light flux of the light channels 101, flux or intensity of the mixture of lights 109 measured by the colour sensor 104 (e.g. clear channel of the colour sensor), etc.

The predefined light flux of the light channels 101 and the measured flux of the mixture of lights 109 may cooperate in determining the second intensity adjustments so that a flux deviation between the predefined light flux and the measured light flux is also minimized. General principles applied to minimizing the colour deviation may be similarly used to minimize said flux deviation. For instance, a third constraint may be imposed to the optimization process (e.g. PID control) for minimizing the flux deviation under a constraint inducing the flux deviation to be less than a flux deviation threshold. This third constraint may have lower priority than first and second constraints. Relative priorities between constraints may be considered so that desired balance between first, second and third constraints is achieved.

By using at least some of the aforementioned inputs, the PID control may progressively calculate, at each iteration, new second intensity adjustments (or weights) that approximate the measured colour point 305 of the mixed lights 109 to the colour point 304 of the reference spectral power distribution 300. Several criteria may be used to effectively determine the second intensity adjustments. For example, a particular second intensity adjustment (or weight) for a given light channel may be chosen to be proportional (or any other functional dependence) to the effectiveness of that light channel to move the measured colour point 305 towards the target colour point 304. A steady state may be reached when the new measured colour point 305 matches the target colour point 304 within certain acceptable tolerances.

Typically, a colour error (or deviation) 306 may usually result small; in particular, colour deviation 306 expressed in terms of the Euclidean distance in the CIE 1976 (L*, u*, v*) colour space or $\Delta E^*_{uv}$ may be kept below 0.01 units (first constraint). In turn, a relative error or deviation 302 (according to e.g. Formula 3 bellow) between the reference (or target) spectral power distribution 300 and the second calculated spectral power distribution 301 (according to e.g. Formula 2) may also result small; in particular, spectral deviation 302 may be kept below 5% (second constraint).

The second constraint may be understood as an upper bound to a relative error between the target spectral power distribution 300 and the second calculated spectral power distribution 301. For example, an absolute error from which the relative error may derive could be calculated as a root mean squared error (RMSE) between the two functions 300, 301, as a mean absolute error (MAE) between the two functions 300, 301, as an area difference between the two functions 300, 301, or any other statistical method that may produce an indicator suitable for evaluating the goodness of an approximation to a target function 300.

In particular examples, a relative (percentage) error rRMSE for a root mean squared error (RMSE) may be calculated through the following formula.

$$rRMSE = \frac{100}{K}\sqrt{\sum_{i=1}^{K}\left(\frac{SPD^i_{target} - \text{second_SPD}^i_{mixed}}{SPD^i_{target}}\right)^2} \qquad \text{Formula 3}$$

Wherein i is an index representing the discretization of the wavelengths (λ—see Formula 2) under consideration, K is the length of the array of discretized wavelengths where the spectral power distributions are defined, $\text{SPD}_{target}^{i}$ is the i-th point of the target spectral power distribution 300, and $\text{second_SPD}_{mixed}^{i}$ is the i-th point of the second calculated spectral power distribution 301.

The behaviour of the PID control may change depending on some design parameters, such as the values of the proportional, integrative and derivative parameters. By setting optimum values to those parameters, the final behaviour of the solution may be controlled in terms of, for example, smoothness, convergence time and overshoot.

In some examples, the PID control may prioritize minimizing colour deviation 306 (first constraint) while allowing certain flexibility in spectral deviation 302 (second constraint). This flexibility may be higher or lower depending on whether an acceptable balance between minimized colour deviation 306 (first constraint) and spectral deviation 302 (second constraint) can be achieved. The aforementioned third constraint may also be considered in this prioritization/balance between constraints.

If a light channel gets damaged or suffers a complete or partial reduction of light flux, the spectral deviation 302 may not be minimized below the required spectral deviation threshold (i.e. second constraint unsatisfied), and the response of the PID control may thus need to evolve towards a state in which only the colour deviation 306 is minimized as desired (i.e. first constraint is satisfied). These situations related to the reliability or malfunction of light channel(s) could be easily identified by the PID control in case that the spectral deviation 302 cannot be minimized as desired (i.e. second constraint unsatisfied). In such cases, a flag could be raised if the spectral deviation 302 in the form of e.g. a relative error is higher than e.g. a given percentage. Other similar criteria could be used instead of relative error such as absolute error, mean square error or any other deviation metrics regularly used in statistics.

Similar considerations to the above ones with reference to PID control may be applied to other known optimization (e.g. statistical) methods based on similar principles and with similar effects.

The optimization method may include varying, from one to another iteration of the closed-loop, all or part of the second intensity adjustments according to one or more variation criteria. This variation may be a random variation and, in particular, a Monte Carlo method or simulated annealing may be used to implement such randomness in the variation of the second intensity adjustments.

The second intensity adjustments to be varied (from one to another iteration of the closed-loop) may correspond to a selection of the light channels 101, which may be determined according to different "selection" approaches.

In a first selection approach, a reference straight line (in a colour space) may be determined connecting the colour coordinates 305 of the mixed lights 109 (in any given colour space) and the colour coordinates 304 of the reference spectral power distribution 300 (in the colour space). For each of the light channels 101, a distance may be determined between the reference straight line and colour coordinates of the light channel. Those light channels for which said distance is below a distance threshold may be included in the selection of light channels to be varied. Light channels with a colour point closer to said reference straight line may be considered as the emitters most influencing the colour deviation 306 and, furthermore, said emitters may also be considered those significantly inducing the spectral deviation 302. Hence, said light channels may be selected to be varied for effectively converging to an optimal solution in minimizing both the colour deviation 306 (first constraint) and spectral deviation 302 (second constraint).

Figure 4:
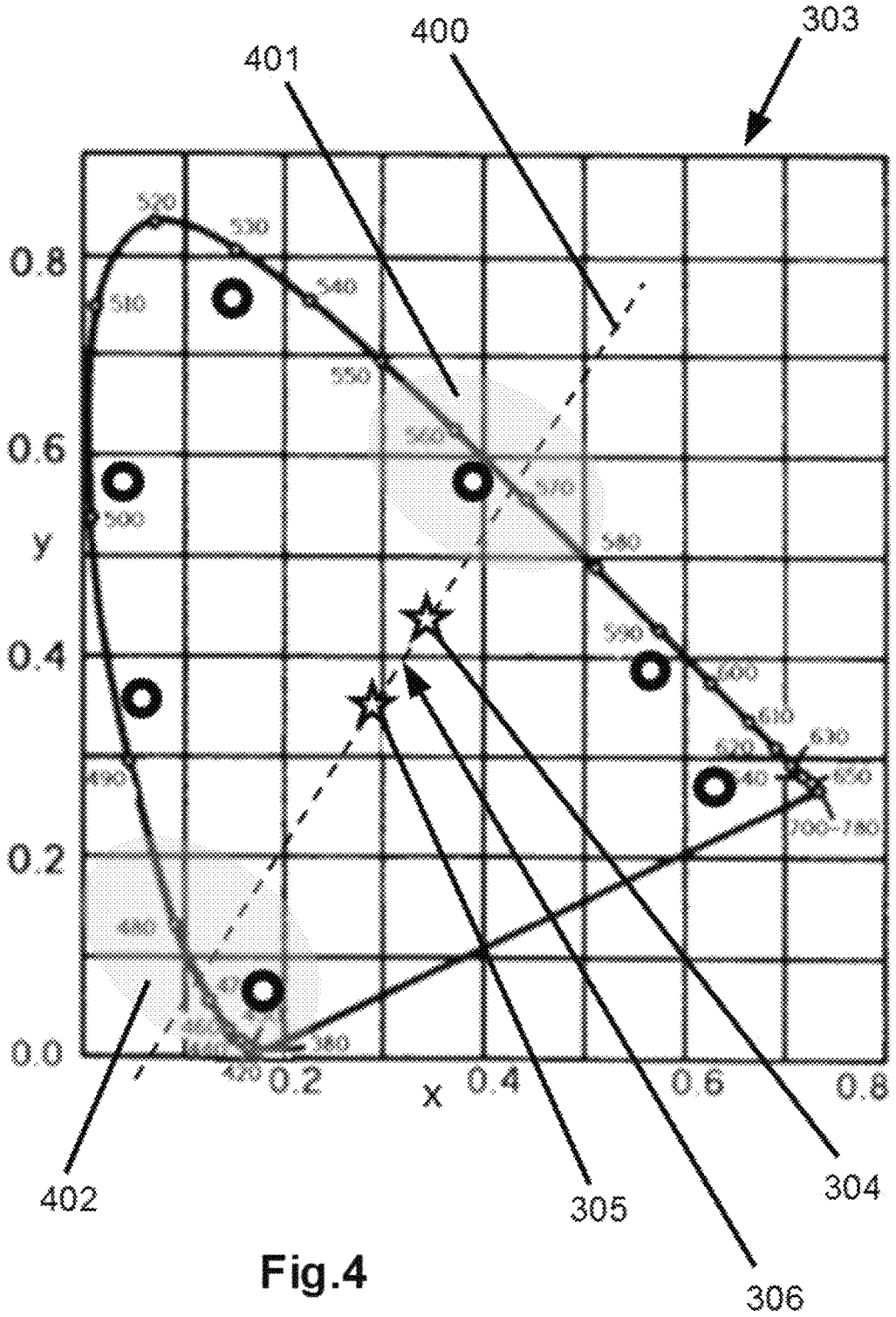
FIG. 4 schematically illustrates an example of selecting light channels to be adjusted, based on clustering the light channels and selecting those light channels belonging to cluster(s) theoretically having a greater influence on the colour deviation.

A second selection approach may be based on a clustering of the light channels 101 and a selection of those light channels belonging to cluster(s) theoretically most influencing the colour deviation 306. FIG. 4 schematically illustrates an example of such second selection approach. Number references from previous figures may be reused and/or referred to in the present figure and following description thereof for designating the same or similar elements.

In the second selection approach, a reference straight line 400 (in a colour space 303) may be determined connecting the colour coordinates 305 of the mixed lights 109 and the colour coordinates 304 of the reference spectral power distribution 300. Regions of influence 401, 402 may be determined corresponding to clusters of colour coordinates of the light channels 101. Those light channels whose corresponding regions of influence 401, 402 at least partially overlap the reference straight line 400 (i.e. light channels significantly influencing the colour deviation 306 and spectral deviation 302) may be included in the selection of light channels. For example, projections representing these clusters of light channels may be used to select most influent light channels in order to speed up the convergence times towards an optimal solution.

Figure 5:
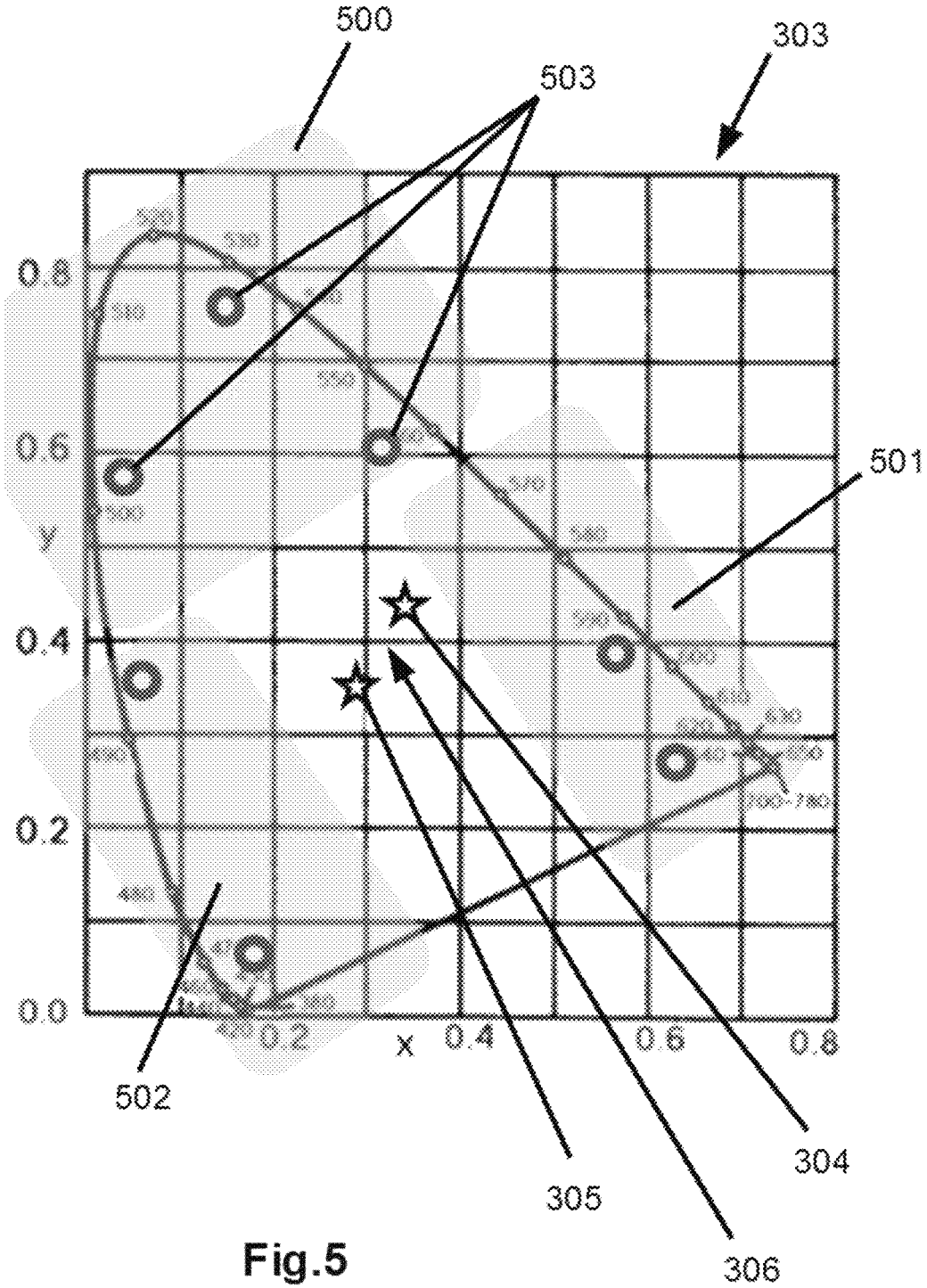
FIG. 5 schematically illustrates a further example of selecting light channels to be adjusted in the 1931 CIE xy diagram, based on considering RGB components of the mixed light and their variation from one to another iteration of the closed-loop.

A third selection approach may be based on considering RGB components of the mixed light 109 and their variation from one to another iteration of the closed-loop. FIG. 5 schematically illustrates an example of said third selection approach. Number references from previous figures may be reused and/or referred to in the present figure and following description thereof for designating the same or similar elements.

In the third selection approach, the sensor signals received by the controller 105 from the colour sensor may include Red, Green and Blue (RGB) colour coordinates of the mixed light (or mixture of lights) 109. The controller 105 may determine which of the received RGB colour coordinates of the mixed light (or mixture of lights) 109 have changed to greatest extent in comparison to RGB colour coordinates received in previous iteration of the closed-loop, respectively. Those light channels whose colour coordinates correspond to a RGB colour of the received RGB colour coordinates that have changed to greatest extent (i.e. those light channels significantly influencing the colour deviation 306 and spectral deviation 302) may be included in the selection of light channels.

In the particular example shown in FIG. 5, Green region 500, Red region 501 and Blue region 502 are represented in the 1931 CIE xy colour space 303. Assuming that e.g. the Green component of the mixed light 109 (received from the colour sensor) is the one that has changed to a greatest extent in relation to the previous iteration of the closed-loop, light channels with colour coordinates 503 in the Green region 500 may be included in the selection of light channels to be varied.

In a fourth selection approach, a first vector may be determined corresponding to colour deviation 306 between colour coordinates 305 of the mixed lights 109 (in colour space 303) and colour coordinates 304 of the reference spectral power distribution 300 (in colour space 303). For each of the light channels, a second vector may be determined corresponding to a further colour deviation between the colour coordinates 304 of the reference spectral power distribution 300 (in colour space 303) and colour coordinates of the light channel (in colour space 303). A projection of the first vector onto the second vector may be determined for each of the light channels. Those light channels for which said projection (of the first vector onto the second vector) exceeds a projection threshold (i.e. those light channels significantly influencing the colour deviation 306 and spectral deviation 302) may be included in the selection of light channels to be varied. A projection of the first vector onto the second vector may be used as a quantifying indicator of the capacity of the corresponding light channel to influence the final solution, and may be passed as an input to the optimization process. This way, the optimization method may initially propose variations over those light channels having a greater influence in the path of finding an optimal solution.

Only one of the first, second, third and fourth selection approaches may be implemented in the optimization (minimization) process of block 204. However, in alternative examples, any combination of said four selection approaches may be used at block 204. Further alternatively, a completely random selection approach may be used. In general, any known approach suitable for selecting those light channels most influencing the mixed light may be considered for the mentioned aim.

In examples of the method, the totality of the channels can be selected to be varied or a subset of the totality of the channels can be randomly or intentionally selected to be varied. This may be implemented e.g. when the computing time of the optimization algorithm is not a concern.

In some situations, there may be design constraints (size, price, etc.) that may result into not fully perfectly mixed light 109. As an example, design constraints may potentially imply that the relative position among the light channels 101, the light mixer 103 and the colour sensor 104 bring about imperfections in the mixture of lights 109. Even though the lighting device functions acceptably in spite of these imperfections, the implementation of the following approach based on "redefining" the colour coordinates of reference may eliminate or minimize the influence of said imperfections and therefore improve, in some examples, the control method and consequent performance of the device.

To this end, the colour coordinates of reference may be substantially equal to colour coordinates of a rectification of the reference spectral power distribution, so that imperfections in the mixture of lights 109 received by the colour sensor 104 may be accounted for. Said imperfections may be due to e.g. small geometrical and/or positional distortions among light emitters (of the light channels 101) and/or light mixer 103 and/or colour sensor 104, degradation of a lens or diffuser or reflector of the light mixer 103, etc. This approach is aimed at making the colour coordinates of reference 304 (corresponding to perfectly mixed lights at the far field) comparable or compatible with the colour coordinates of the (potentially imperfect) mixture of lights 109 sensed by the colorimeter 104 (at the near field).

The rectification of the reference spectral power distribution 300 (and/or any derived data such as e.g. its colour coordinates) may be pre-stored in a memory of the lighting device, so that the controller (of the lighting device) may retrieve said data whenever required. The colour coordinates of the rectification of the reference spectral power distribution 300 may be calculated (by the controller of the lighting device or by a computing system connectable to the lighting device) based on any known method aimed at that end.

Methods of example may include predetermining the rectification of the reference spectral power distribution 300 and, optionally, its corresponding colour coordinates, and any of said data may be pre-stored in corresponding memory associated with the controller (of the lighting device).

According to examples, predetermining the rectification of the reference spectral power distribution 300 may include determining, for each of the light channels 101, a distorted spectral power distribution of the light channel. Then, the rectification of the reference spectral power distribution may be (pre)determined depending on (a relation or function between) the predefined spectral power distributions and said distorted spectral power distributions of the light channels. The term "distorted" is used herein to indicate that spectral power distributions of the light channels may become distorted or modified due to particular conditions of the lighting device potentially inducing some imperfections in the mixture of lights received by the colour sensor (near field).

In some examples, determining the distorted spectral power distribution of an i-th light channel may include producing a test signal for inducing the i-th light channel to emit an i-th test light while the other light channels are off. An i-th test measurement of the i-th test light having been (potentially) distorted by the light mixer may then be received from the colour sensor, so that the distorted spectral power distribution of the i-th light channel may be determined depending on the received i-th test measurement.

The i-th test measurement may include a parameter $A_i^{distort}$ corresponding to an amplitude (or channel peak value expressed in a magnitude proportional to any photometric or radiometric unit) of the i-th test light (having been potentially distorted by the light mixer) and sensed by a clear channel of the colour sensor (or by a linear combination of RGB channels proportional to luminance or illuminance received by the colour sensor).

The aforementioned relation (or function) between predefined and (potentially) distorted spectral power distributions may include a coefficient $\eta_i$ for each of the light channels, which may be determined through the following formula:

$$\eta_i = \frac{A_i^{distort}}{A_i^{predef}} \qquad \text{Formula 4}$$

wherein $A_i^{distort}$ is the parameter defined above associated to the i-th channel, and $A_i^{predef}$ corresponds to an amplitude (or channel peak value expressed in a magnitude proportional to any photometric or radiometric unit) of the predefined spectral power distribution of the i-th channel.

If $A_i^{distort}$ and $A_i^{predef}$ were substantially equal to each other, it would mean that no distortion or just a negligible distortion of the spectral power distributions has occurred.

For the sake of understanding, $A_i^{distort}$ may be seen as representing the contribution (weight) of the i-th light channel in the mixture of lights received by the colour sensor (at the near field) with potentially some "mixing" imperfection(s), whereas $A_i^{predef}$ may be seen as representing the same as $A_i^{distort}$ but under the assumption that lights emitted by the light channels are perfectly mixed (at the far field).

The rectification of the reference spectral power distribution $SPD_{rectif}$ may be determined through e.g. the following formula:

$$SPD_{rectif} = \sum_{i=1}^{N} SPD^i_{channel}(\lambda) \times \eta_i \times \text{second_weight}_i \qquad \text{Formula 5}$$

wherein N is the number of light channels, $SPD_{channel}^{i}(\lambda)$ is the predefined spectral power distribution of the i-th light channel, $\eta_i$ is the coefficient applicable to the i-th light channel (determined according to Formula 4), and second_weight$_i$ is the second intensity adjustment or weight of the i-th light channel determined by the optimization/minimization process (performed at e.g. block 204 of FIG. 2).

The proposed redefinition of the colour coordinates of reference for attenuating imperfection(s) in the mixture of lights received by the colorimeter may be included in any of the controlling methods disclosed herein. Coefficients $\eta_i$ (see Formula 4) may be recalculated and updated regularly (periodically), so that degradation(s) of the lighting device (occurred e.g. during its operation life) potentially distorting the mixture of the lights may be compensated.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A method of controlling a lighting device by a controller, for the lighting device to produce illumination based on a reference spectral power distribution, the lighting device comprising a plurality of light channels with predefined spectral power distributions, a light mixer, and a colour sensor; the method comprising:

determining, by the controller, first intensity adjustments of the light channels for minimizing a first spectral deviation between a first calculated spectral power distribution and the reference spectral power distribution, the first calculated spectral power distribution depending on the predefined spectral power distributions of the light channels and the first intensity adjustments;

sending, by the controller, first control signals to the light channels for inducing the light channels to emit lights based on the first intensity adjustments;

receiving, by the controller, sensor signals from the colour sensor representing colour coordinates of a mixture of lights resulting from interaction of the lights emitted by the light channels with the light mixer;

performing, by the controller, an optimization process producing second intensity adjustments for minimizing a colour deviation between colour coordinates of reference and the colour coordinates of the mixture of lights; and sending, by the controller, second control signals to the light channels for inducing the light channels to emit lights based on the second intensity adjustments.

2. The method of controlling a lighting device according to claim 1, the colour coordinates of reference being substantially equal to colour coordinates of the reference spectral power distribution.

3. The method of controlling a lighting device according to claim 1, the colour coordinates of reference being substantially equal to colour coordinates of a rectification of the reference spectral power distribution.

4. The method of controlling a lighting device according to claim 3, further comprising predetermining the rectification of the reference spectral power distribution.

5. The method of controlling a lighting device according to claim 4, the predetermining the rectification of the reference spectral power distribution comprising:

determining, for each of the light channels, a distorted spectral power distribution of the light channel; and determining the rectification of the reference spectral power distribution depending on the predefined spectral power distributions and the determined distorted spectral power distributions of the light channels.

6. The method of controlling a lighting device according to claim 5, the determining the distorted spectral power distribution of the light channel comprising:

producing a test signal for inducing the light channel to emit a test light while the other light channels are off;

receiving, from the colour sensor, a test measurement of the test light having been distorted by the light mixer;

determining the distorted spectral power distribution of the light channel depending on the received test measurement.

7. The method of controlling a lighting device according to claim 1, the receiving the sensor signals from the colour sensor, performing the optimization process, and sending the second control signals to the light channels being performed as a closed-loop.

8. The method of controlling a lighting device according to claim 1, the performing the optimization process comprising minimizing, by the controller, the colour deviation under a constraint inducing the colour deviation to be less than a colour deviation threshold.

9. The method of controlling a lighting device according to claim 8, the colour deviation threshold being one or both of between $\Delta E^*_{uv}=10^{-5}$ and $\Delta E^*_{uv}=10^{-1}$, and equal to approximately $\Delta E^*_{uv}=10^{-3}$.

10. The method of controlling a lighting device according to claim 8, the colour deviation threshold being substantially equal to a smallest colour deviation recorded previously.

11. The method of controlling a lighting device according to claim 1, the performing the optimization process comprising minimizing, by the controller, the colour deviation under a constraint inducing a second spectral deviation to be less than a spectral deviation threshold, the second spectral deviation being a deviation between a second calculated spectral power distribution and the reference spectral power distribution, the second calculated spectral power distribution depending on the predefined spectral power distributions of the light channels and the second intensity adjustments.

12. A computer program product comprising program instructions for causing a controller of a lighting device to perform a method according to claim 1 for controlling a lighting device.

13. The computer program product according to claim 12, embodied on a storage medium and/or carried on a carrier signal.

14. A controller for controlling a lighting device for producing illumination based on a reference spectral power distribution, the lighting device comprising a plurality of light channels with predefined spectral power distributions, a light mixer, and a colour sensor; and the controller being configured to perform a method according to claim 1 for controlling the lighting device.

15. The controller according to claim 14, the controller comprising a memory and a processor, embodying instructions stored in the memory and executable by the processor, the instructions comprising functionality to execute the method of controlling the lighting device.

16. A lighting device comprising the controller according to claim 14, the plurality of light channels, the light mixer, and the colour sensor.

17. The lighting device according to claim 16, the light mixer being arranged relative to the light channels in such a way that lights emitted by the light channels are mixed by the light mixer.

18. The lighting device according to claim 16, the colour sensor comprising light diffusing material associated to one or more light inlets of the colour sensor in such a way that said light diffusing material cooperates with the light mixer in mixing the lights emitted by the light channels.

19. The lighting device according to claim 16, the light mixer comprising a mixing chamber covering the light channels in such a way that lights emitted by the light channels are partially reflected internally to the mixing chamber.

20. The lighting device according to claim 16, the light mixer comprising a shell mixer including a hollow dome covering the light channels and mini-lenses arranged on outer and inner surfaces of the hollow dome.

* * * * *